US010815021B2

(12) United States Patent
Vega

(10) Patent No.: US 10,815,021 B2
(45) **Date of Patent: *Oct. 27, 2020**

(54) HIGH SPEED LABEL APPLICATOR AND METHODS

(71) Applicant: Label-Aire, Inc., Fullerton, CA (US)

(72) Inventor: Israel Vega, Brea, CA (US)

(73) Assignee: Label-Aire, Inc., Fullerton, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/351,305

(22) Filed: Mar. 12, 2019

(65) Prior Publication Data

US 2019/0270534 A1 Sep. 5, 2019

Related U.S. Application Data

(63) Continuation of application No. 15/791,102, filed on Oct. 23, 2017, now Pat. No. 10,351,290, which is a continuation of application No. 13/956,233, filed on Jul. 31, 2013, now Pat. No. 10,040,591.

(60) Provisional application No. 61/678,369, filed on Aug. 1, 2012.

(51) Int. Cl.
*B65C 9/18* (2006.01)
*B65C 3/14* (2006.01)

(52) U.S. Cl.
CPC ..... *B65C 9/188* (2013.01); *B65C 3/14* (2013.01); *Y10T 156/17* (2015.01); *Y10T 156/1744* (2015.01)

(58) Field of Classification Search
CPC ..... B65C 9/188; B65C 3/14; Y10T 156/1322; Y10T 156/1317; Y10T 156/12
See application file for complete search history.

(56) References Cited

U.S. PATENT DOCUMENTS

| | | | |
|---|---|---|---|
| 3,262,832 | A | 7/1966 | Fairest |
| 3,834,963 | A | 9/1974 | Hoffman |
| 4,188,843 | A | 2/1980 | Dickey |
| 4,210,484 | A | 7/1980 | Crankshaw et al. |
| RE30,419 | E | 10/1980 | Crankshaw et al. |
| 4,255,220 | A | 3/1981 | Kucheck et al. |
| 4,526,645 | A | 7/1985 | Malthouse et al. |
| 4,680,082 | A | 7/1987 | Kearney |

(Continued)

FOREIGN PATENT DOCUMENTS

| | | | |
|---|---|---|---|
| WO | 2005035263 | A1 | 4/2005 |
| WO | 2006016823 | A1 | 2/2006 |
| WO | 2009120096 | A1 | 10/2009 |

OTHER PUBLICATIONS

International Search Report and Written Opinion dated Sep. 25, 2015 for PCT App. No. PCT/US2015/012089.

*Primary Examiner* — Mark A Osele
*Assistant Examiner* — Christopher C Caillouet
(74) *Attorney, Agent, or Firm* — Stout, Uxa & Buyan, LLP; Donald E. Stout

(57) ABSTRACT

A label application system for applying labels to relatively short, round, straight-walled articles is constructed and designed so that labels to be applied to passing articles are delivered to the label application zone on a carrier web in a short feed orientation, with each label being oriented lengthwise across a width of the carrier web. At the time of labeling, the label is held stationary on a flat vacuum surface, and the label is applied by spinning the articles past the vacuum surface. As a result, the system is capable of labeling articles at processing speeds of at least 450 articles per minute or more.

18 Claims, 5 Drawing Sheets

(56) References Cited

U.S. PATENT DOCUMENTS

| | | | |
|---|---|---|---|
| 4,758,300 | A | 7/1988 | King |
| 4,844,771 | A | 7/1989 | Crankshaw et al. |
| 4,931,122 | A | 6/1990 | Mitchell |
| 5,039,374 | A | 8/1991 | Winter |
| 5,082,520 | A | 1/1992 | West et al. |
| 5,421,948 | A | 6/1995 | Crankshaw et al. |
| 5,512,120 | A | 4/1996 | Hinton et al. |
| 5,643,395 | A | 7/1997 | Hinton |
| 5,645,669 | A | 7/1997 | Crankshaw et al. |
| 5,935,361 | A | 8/1999 | Takahashi et al. |
| 5,964,975 | A | 10/1999 | Hinton |
| 2002/0029856 | A1 | 3/2002 | Gonzalo |
| 2003/0121593 | A1 | 7/2003 | Monroe |
| 2005/0161164 | A1 | 7/2005 | Sleiman et al. |
| 2013/0199716 | A1 | 8/2013 | Vega et al. |
| 2015/0151868 | A1 | 6/2015 | Vega |

HIGH SPEED LABEL APPLICATOR AND METHODS

This application is a continuation under 35 U.S.C. 120 of U.S. application Ser. No. 15/791,102, entitled High Speed Label Applicator and Methods, filed on Oct. 23, 2017, presently pending, which is turn is a continuation under 35 U.S.C. 120 of U.S. application Ser. No. 13/956,233, entitled High Speed Label Applicator and Methods, filed on Jul. 31, 2013 and now issued as U.S. Pat. No. 10,040,591, which in turn claims the benefit under 35 U.S.C. 119(e) of the filing date of Provisional U.S. Application Ser. No. 61/678,369, entitled High Speed Label Applicator and Methods, filed on Aug. 1, 2012. Each of the prior applications, which are commonly assigned, are expressly incorporated herein by reference, in their entirety.

FIELD OF THE INVENTION

This invention relates generally to label applicators and more particularly, to label applicators and methods using vacuum surface systems for applying labels to generally cylindrical objects having diameters substantially larger than their height.

BACKGROUND OF THE INVENTION

Label applicators for applying pressure-sensitive adhesive-backed labels to articles passing the applicator on a conveyor are well known. Label applicators of this general type are shown in commonly assigned U.S. Pat. No. 4,255,220, issued to Kucheck et al., U.S. Pat. No. 4,844,771, issued to Crankshaw et al., and U.S. Pat. No. 5,421,948, issued to Crankshaw et al, for example. Other prior art references of interest include Published U.S. Patent Application No. 2003/0121593, U.S. Pat. No. 5,935,361 to Takahashi et al., U.S. Pat. No. 5,643,395 to Hinton, U.S. Pat. No. 5,039,374 to Winter, Published U.S. Patent Application No. US 2003/0121593, International Publication No. WO 2005/035263, International Publication No. 2006/016823, and International Publication No. 2009/120096. All of the aforementioned patents and published patent applications are herein expressly incorporated by reference, in their entirety. Typically, such labeling apparatus comprise a supply of adhesive-backed labels carried upon an elongate web of release material which is fed from a supply reel to a take-up reel, with the label applicator disposed between the two reels.

One particular category of articles to be labeled are round articles, such as snuff cans, tuna cans, and the like, where the label to be applied is long and narrow relative to its length and the article has a wall which is substantially straight. Typically, because of limitations in currently available labeling equipment, such labels are disposed in a "long feed" configuration on the web to be fed into the label applicator. "Long feed" label configurations are inefficient, in that the label feed mechanism must advance a greater distance (at least the length of each label) to deliver each label and fewer labels can be carried on each roll, thereby requiring change out of the label roll more often. Since the label application system must be shut down to perform the label roll change out, this reduces labeling volume. Current long feed systems can only handle about 300 articles per minute.

Accordingly, it would be advantageous to have a labeling system which would be capable of labeling such round articles using a "short feed" label configuration, as such an arrangement would be much more efficient and permit much faster labeling processing speeds.

SUMMARY OF THE INVENTION

In one aspect of the invention, a label application system for applying labels to round, straight-walled articles is provided, which comprises a main frame and a label applicator assembly comprising a vacuum surface for receiving and retaining a label to be applied to a cylindrical surface of an article thereon with its adhesive side up. A conveyor assembly has a conveyor for transporting articles to be labeled past the label applicator assembly. The conveyor assembly comprises a label application zone adjacent to the label applicator assembly. A pressure control assembly, which may comprise either a feedscrew assembly or a vertically oriented moving belt assembly is disposed upstream of the label application zone dispensing individual articles to be labeled as they travel down the conveyor toward the label application zone. A belt is provided for rotating the articles as they enter the label application zone. Importantly, the vacuum surface is stationary while a label is being applied to the article cylindrical surface.

In one embodiment, the vacuum surface comprises a substantially flat vacuum pad disposed on a tamp assembly. In another embodiment, the vacuum surface comprises a portion of a circumferential surface of a vacuum drum assembly located adjacent to the label application zone for applying labels to passing articles. In this embodiment, the vacuum drum assembly comprises a plurality of label flats disposed about its circumferential surface, each of the label flats comprising a substantially flat surface extending across substantially an entire width of the drum and having a plurality of vacuum apertures therein, for delivering a vacuum pressure to the surface of the label flat to hold a label in place on the label flat surface with its adhesive side up. The circumferential surface of the drum comprises angled transitional edges between each label flat.

A motor is provided for rotating the vacuum drum in a stepwise fashion, to receive individual labels sequentially as they are separated from a carrier web traveling over a peeler bar adjacent to the vacuum drum. Preferably, the motor comprises a stepper motor.

The vacuum drum is constructed to be modular, so that the plurality of label flats which together comprise its circumferential surface may be changed out, individually or as a unit, to customize the size of each label flat to correspond substantially to the size of labels being applied in a particular labeling operation.

Labels to be applied to passing articles are delivered to the label application zone on a carrier web in a short feed orientation, with each label being oriented lengthwise across a width of the carrier web. As a result, and because of the other innovative features of the present system, the system is capable of labeling articles at processing speeds of approximately 450 articles per minute or more. The labels applied using the system have a length to width ratio of at least about 5:1, and in some cases of at least about 8:1.

In another aspect of the invention, there is provided a vacuum drum assembly for a label application system, which comprises a generally cylindrical drum having a circumferential surface defining a hollow interior. A plurality of label flats are disposed about the circumferential surface of the drum, each label flat comprising a substantially flat surface extending across substantially an entire width of the drum and being sized to accommodate a label to be applied to passing articles. The label flat surface is interspersed with apertures for delivering a vacuum pressure within the hollow interior of the drum to the surface of the label flat for retaining a label on the flat with its adhesive side up. The circumferential surface of the drum comprises angled transitional edges between each label flat.

A motor is provided for rotating the vacuum drum in a stepwise fashion to receive individual labels sequentially as they are separated from a carrier web traveling over a peeler bar adjacent to the vacuum drum, preferably a stepper motor.

Advantageously, the vacuum drum is constructed to be modular, so that the plurality of label flats which together comprise its circumferential surface may be changed out, individually or as a unit, to customize the size of each label flat to correspond substantially to the size of labels being applied in a particular labeling operation.

In yet another aspect of the invention, there is disclosed a method for applying labels to round, straight-walled articles, comprising a step of feeding a label having a length and a width onto a flat, planar vacuum surface, so that the entire length and width of the label is disposed on the flat, planar vacuum surface, so that an adhesive side of the label faces outwardly toward articles passing by the flat, planar vacuum surface on a conveyor in a downstream direction of travel. Additional steps include retaining the label on the flat, planar vacuum surface using applied vacuum pressure, holding the flat, planar vacuum surface in a stationary position as an article to be labeled enters a label application zone adjacent to the flat, planar vacuum surface, and applying the label to the article to be labeled in the label application zone while holding the flat, planar vacuum surface in the stationary position. The flat, planar vacuum surface may comprise a flat vacuum pad.

A pressure control assembly is disposed upstream of the label application zone for dispensing individual articles to be labeled as they travel along the conveyor toward the label application zone. The feeding step includes feeding a carrier web on which a plurality of the labels are disposed, and separating the label from the carrier web to feed the label onto the flat, planar vacuum surface using a peeler bar adjacent to the flat, planar vacuum surface. In disclosed embodiments, the carrier web feeding direction is transverse to the downstream direction of travel of the conveyor.

In some embodiments, the flat, planar vacuum surface comprises a portion of a circumferential surface of a vacuum drum assembly located adjacent to the label application zone for applying labels to passing articles, the method comprising a further step of rotating the vacuum drum assembly about an axis lying parallel to the direction of travel of the conveyor. The step of holding the flat, planar vacuum surface in a stationary position as an article to be labeled enters a label application zone adjacent to the flat, planar vacuum surface comprises rotating the vacuum drum assembly in a stepwise fashion to receive individual labels sequentially as they are separated from the carrier web and to hold the flat, planar vacuum surface stationary while individual labels are being applied to passing articles.

A stepper motor is used to rotate the vacuum drum assembly in a stepwise fashion.

Further method steps comprise providing the vacuum drum assembly with a plurality of label flats disposed about its circumferential surface, each of the label flats comprising the flat, planar vacuum surface extending across substantially an entire width of the drum and having a plurality of vacuum apertures therein, for delivering a vacuum pressure to the surface of the label flat to hold a label in place on the label flat surface with its adhesive side up, wherein the circumferential surface of the drum comprises angled transitional edges between each label flat.

In some embodiments, the vacuum drum is constructed to be modular, the method further comprising a step of changing out one or more of the label flats to customize the size of the label flats to correspond to a particular label size.

The method further comprises a step of conveying the articles to be labeled through the label application zone at speeds of at least 450 articles per minute.

The invention, together with additional features and advantages thereof, may best be understood by reference to the following description taken in conjunction with the accompanying illustrative drawings.

DETAILED DESCRIPTION OF THE INVENTION

Figure 1:
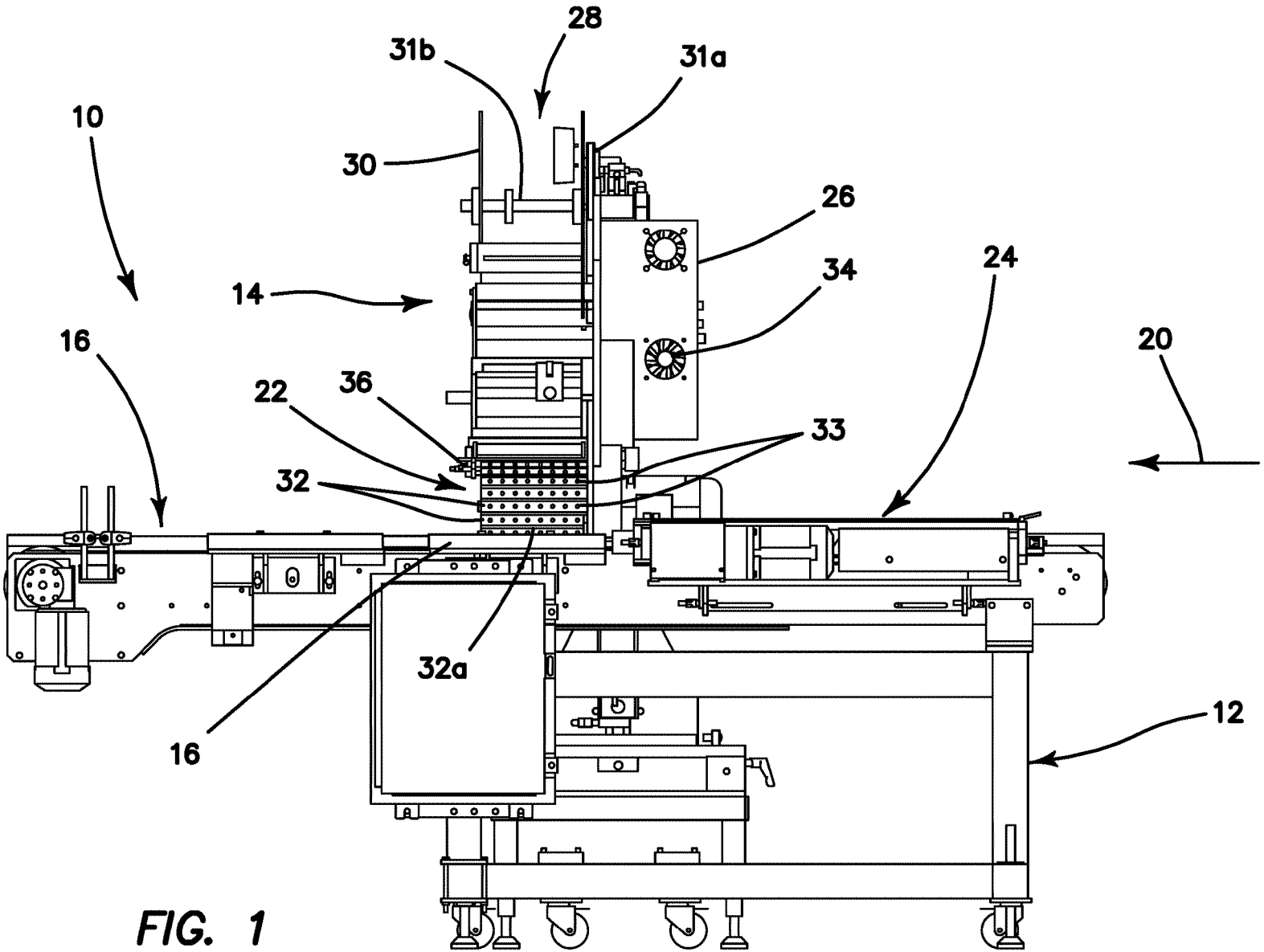
FIG. 1 is an elevational view of one embodiment of a labeling system constructed in accordance with the principles of the present invention.
Figure 2:
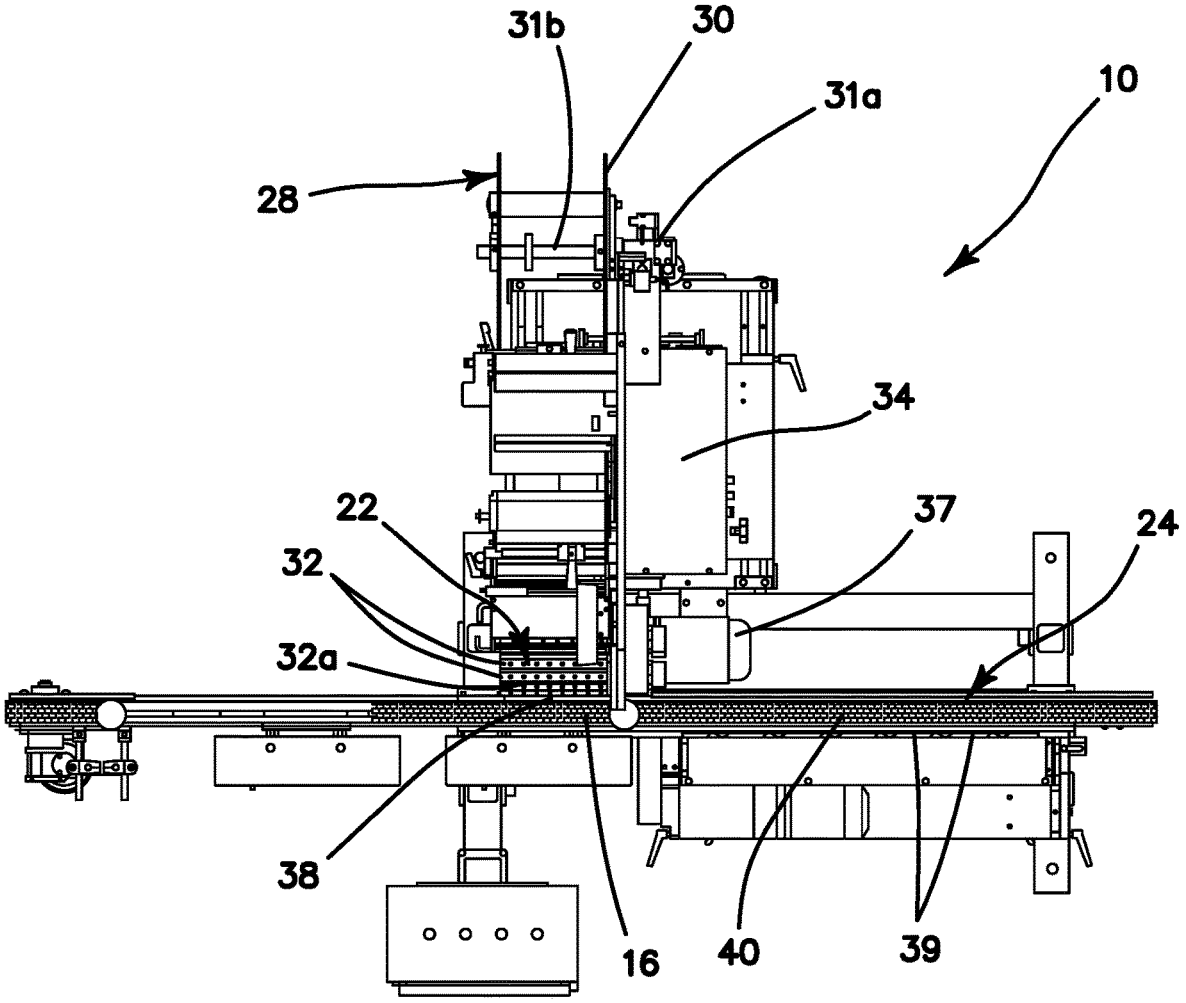
FIG. 2 is a top view of the labeling system of FIG. 1.

Referring now more particularly to the drawings, wherein like reference numerals designate identical or corresponding parts throughout the several views and embodiments, there is shown in FIGS. 1 and 2 one embodiment of a label application system 10 constructed in accordance with the principles of the present invention. The system 10 comprises a main frame 12, a label applicator assembly 14, and a conveyor assembly 16, for transporting articles to be labeled past the label applicator assembly. Arrow 20 illustrates the direction of product flow on the conveyor assembly 16.

Other elements of the system 10 to be described below include a vacuum drum assembly 22, a feedscrew assembly 24, and a control panel 26.

The inventive system 10 is particularly adapted to label short, round and straight-walled articles 27 (FIG. 4), such as snuff cans, tuna cans, and the like, where the label to be applied is long and narrow relative to its length and the article has a wall which is substantially straight. The labels at issue typically have a length which exceeds their width by a length to width ratio of about 5:1 or more, in some cases 8:1 or more. Typically, because of limitations in currently available labeling equipment, such labels are disposed in a "long feed" configuration on the web to be fed into the label applicator. "Long feed" label configurations are inefficient, in that the label feed mechanism must advance a greater distance (at least the length of each label) to deliver each label and fewer labels can be carried on each roll, thereby requiring change out of the label roll more often. Since the label application system must be shut down to perform the label roll change out, this reduces labeling volume. Current long feed systems can only handle about 300 articles per minute.

The current inventive labeling system is able to apply the labels in a "short feed" orientation, meaning that the labels are disposed with their length lying along the width of the carrying web. This allows substantially more labels to be carried on each label roll, reducing change-out shutdowns of the system. Additionally, the web need only advance by a distance equal to the width of the label, plus any space between adjacent labels, to deliver the next label to the application zone. As a result, the present system is capable of labeling as many as 450 articles per minute or more, an efficiency increase of at least about 50% over prior art systems.

Now, with more particular reference to FIGS. 1-4, the system 10 will be described in greater detail. The label applicator 14 comprises an unwind assembly 28 having an unwind disk 30 on which is carried a roll of labels for application to the passing articles 27 (FIG. 4) on the conveyor 16, which moves in a direction indicated by the arrow 20. The unwind assembly 28 is comprised of the aforementioned assembly unwind disk 30, as well as an assembly unwind drive mechanism 31*a* with brake, and a shaft or spindle 31*b* for accommodating the roll of labels. The unwind assembly 28 is rotatably driven through the assembly unwind drive mechanism 31*a*.

Figure 3:
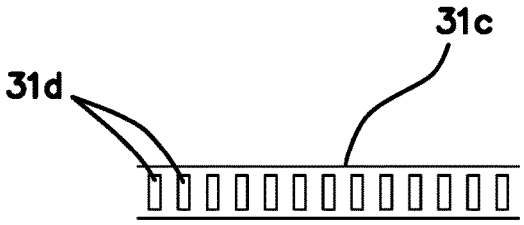
FIG. 3 is a schematic view showing a length of carrier web with labels of the type to be applied using the inventive system disposed thereon.

As noted above, the roll of labels comprises a carrier web, with a series of labels disposed on the web, adhesive side down. The labels are typically pre-printed with appropriate brand and content information. The labels are arranged in a short feed orientation, wherein the length of each label is oriented to extend across the width of the carrier web, with a desired spacing between successive labels. A portion of a length of carrier web 31*c*, having a plurality of labels 31*d* disposed thereon, is shown in FIG. 3.

Figure 4:
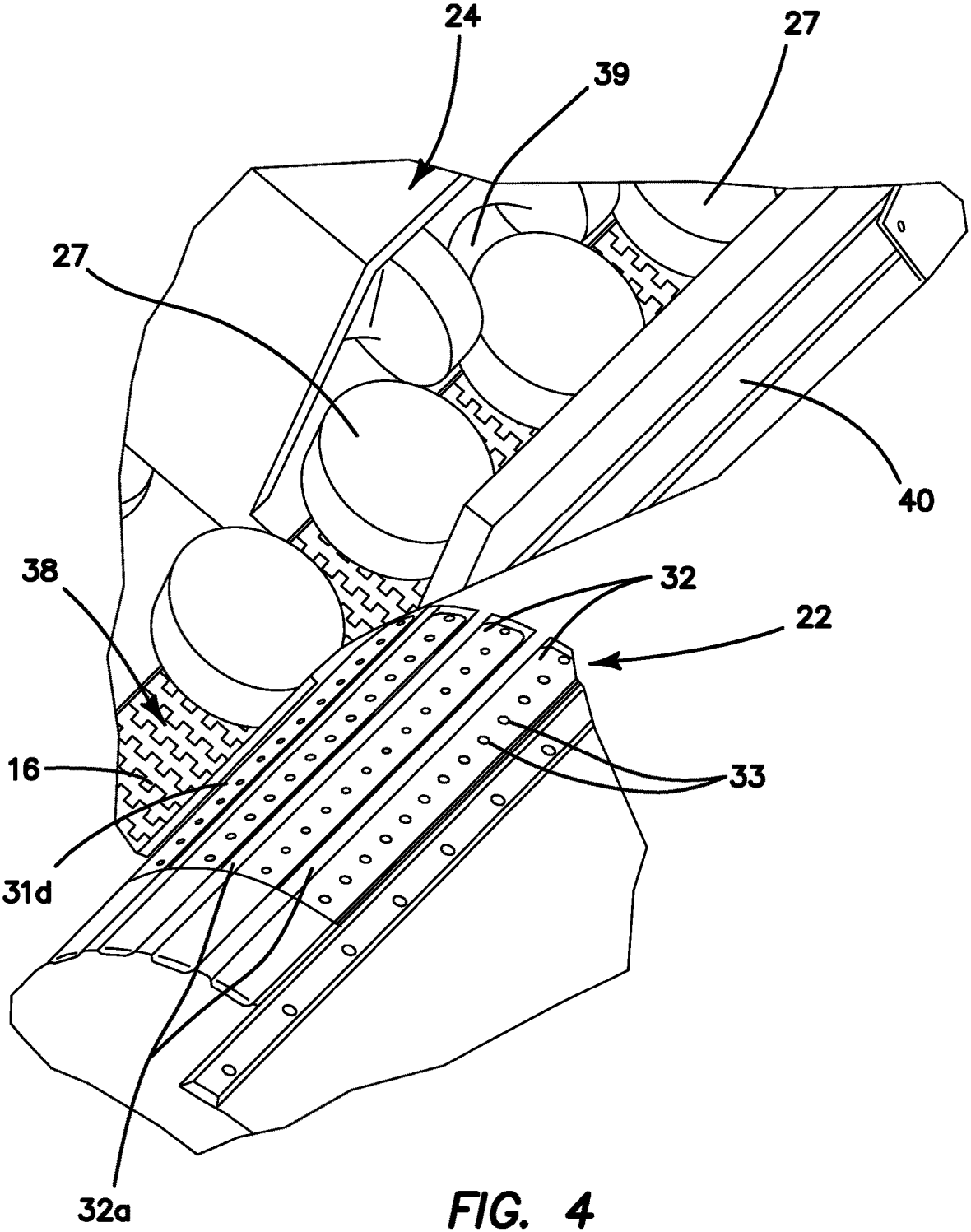
FIG. 4 is an illustration of one approach for dispensing articles to be labeled from the feed screw of the inventive system into the label application zone.

The carrier web 31*c*, unwinding from the unwind assembly 28, is routed about idler rollers along a feedpath to the vacuum drum 22 (FIGS. 1, 2, 4). The vacuum drum is constructed to comprise a plurality of label flats 32. Each label flat comprises a substantially flat surface interspersed with vacuum apertures 33, wherein the surface of each label flat is sized to accommodate a label separated from the carrier web. In the illustrated example, there are twenty label flats 32 which together comprise the outer circumferential surface of the vacuum drum 22. Angled transitional edges 32*a* are disposed between each label flat 32, formed by the respective joined edges of each label flat. The vacuum drum 22 is constructed to be modular, so that label flats 32 are interchangeable. Because of this modular construction, the number and size of the label flats 32 on each drum can be changed out depending upon the size of the label to be applied. As is typical with prior art non-modular vacuum drums, the interior of the vacuum drum 22 is hollow, and connected to vacuum fans or pumps 34 for drawing a vacuum through the vacuum apertures 33 in the surface of each label flat 32, and through the hollow interior of the drum 22, to hold the non-adhesive side of a label on each label flat 32. It is noted that having a flat vacuum surface for receiving each label is important to the efficient functionality of the system, and its unique and previously unknown ability to apply labels to short, round, straight-walled articles at speeds substantially in excess of 300 articles per minute.

As is known in the art, the label feedpath from the label roll is directed to a label peeler 36 for separating the label from the carrier web and delivering it to the next available label flat 32, with the non-adhesive side down. Thus, the non-adhesive side of the label is held by the vacuum pressure against the surface of the label flat 32, with the adhesive side facing outwardly. This process continues as the vacuum drum is rotated in stepwise fashion, using a stepper motor 37 or the like, advancing rotationally the distance of the width of a single label flat 32 with each step, to simultaneously present one label flat 32 to the peeler 36 for delivery of a label onto the surface of that label flat, and to a label application zone 38 for delivery of another label, disposed on the surface of another label flat 32, to an article passing through the label application zone 38.

Within the control panel 26 are disposed the electrical controls necessary to operate the system. These controls are, generally speaking, typical in the industry and will not be further described herein.

In operation, an operator activates the label application system by actuation of an appropriate control switch on an operator control panel 26. Once operational, the roll of labels is unwound from the unwind assembly 28, so that the carrier web travels along the feedpath of the device, about idler rollers. As a result, a leading edge of the carrier web reaches the label peeler 36, and a first label is separated from the web and disposed onto a label flat on the vacuum drum 22. As noted above, the label is retained on the surface of a label flat 32 because of vacuum pressure applied through the vacuum apertures 33 on that surface, by the fans 34, with its adhesive side out. The vacuum drum is stepped rotationally, by the motor 37, as the carrier web is advanced by the width of a label, plus the spacing between adjacent labels on the web, until the next label is applied, by the peeler 36, to the next label flat 32. This process continues as the vacuum drum continues to be stepped rotationally in the same manner, so that each label flat 32 receives a label. In the meantime, the conveyor assembly 14 is activated so that articles to be labeled travel toward the label application zone 38, in the direction of the arrow 20.

The feedscrew assembly 24 is constructed to rotate adjacent to the conveyor belt, for timing purposes, in a manner well known in the labeling art, so that passing articles are received into grooves 39 between the screws of the feedscrew, thus spacing them appropriately as they sequentially enter the label application zone. The feedscrew assembly 24 comprises a back pressure control station, controlling the article pressure generated by the mass quantity of articles at the in-feed, and also creates article separation. As an article to be labeled travels toward the label application zone 38 and approaches the vacuum drum 22, it is placed into a spinning rotation by its contact with and travel along an adjacent vertically-oriented flat belt assembly, in a position opposed to the labeling surface of the vacuum drum 22, which comprises a part of the conveyor system 16. Such a system is not dissimilar to the system shown and disclosed in U.S. Pat. No. 4,931,122 to Mitchell, herein expressly incorporated by reference, in its entirety. However, advantageously, in the inventive system, the article 27 is dispensed out of the feedscrew and is set into rotation as it contacts the outwardly facing adhesive side of the next label to be applied, on a label flat 32 which has been rotated into the label application zone 38. This contact causes the end of the label to adhere to the side wall of the article. As the spinning article continues to move along the conveyor, its spinning action against the adhesive side of the label causes that label to be wrapped about the article, thus completing the labeling process. This approach is in contrast of that known in the prior art, represented by Mitchell, wherein the feedscrew 15 extended downstream, adjacent and opposed to the vacuum drum 11, so that the article being labeled in the Mitchell patent was still disposed in the grooves of the feedscrew as it was being labeled. This prior art approach is not suitable from the short, round articles 27 for which the inventive system is intended. The inventor has discovered that it is not necessary to employ a prior art starwheel to continue the rotation of articles to be labeled within the label application zone, as previously thought. They can be maintained in an adequately spinning state through the label application zone simply by use of the aforementioned flat belt assembly, thus resulting in an advantageously simpler and faster labeling system, as well as one which is efficient since it allows for a label short feed orientation, as discussed above.

Figure 7:
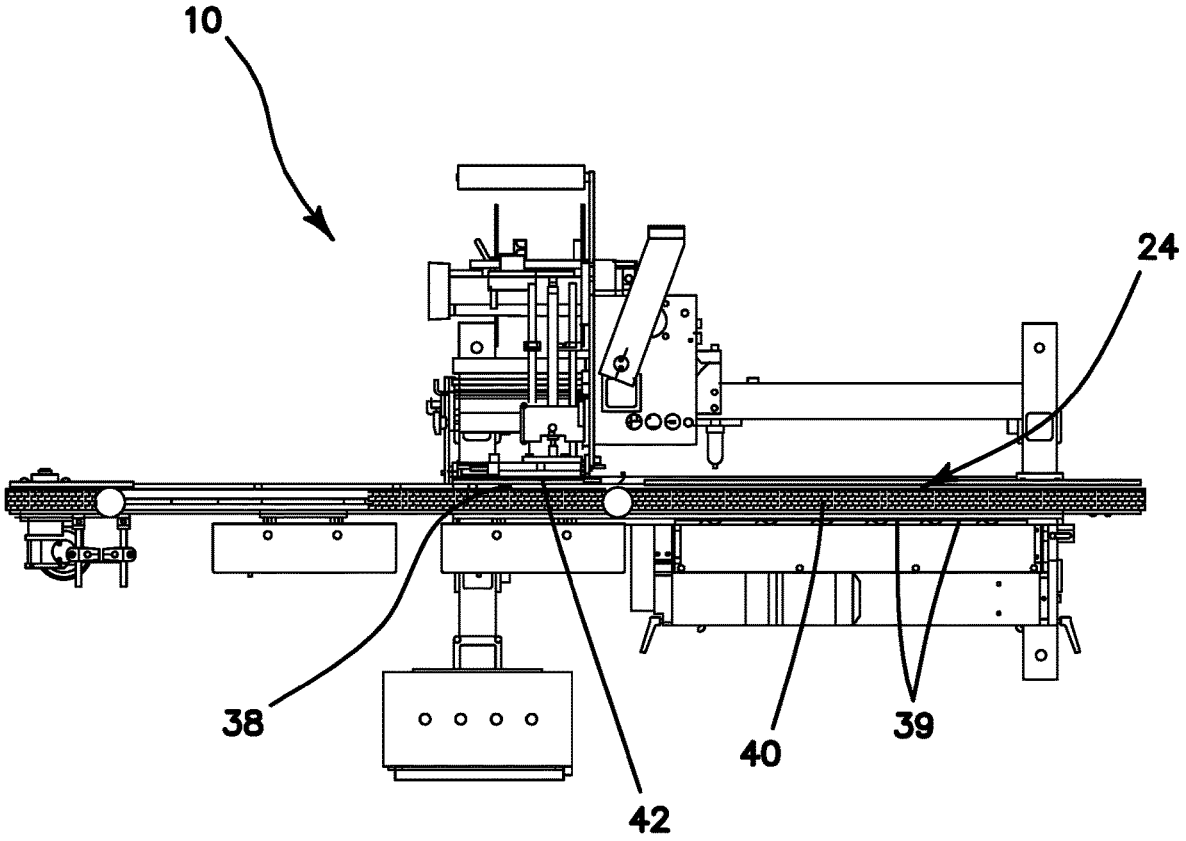
FIG. 7 is a top view of the embodiment of FIGS. 5 and 6.

FIGS. 2, 4, and 7 illustrate an alternative apparatus 40, namely a vertically oriented moving belt assembly, which may be utilized instead of the feedscrew assembly 24 for operation as the pressure control station.

In the inventive system, the labeled article 27, after passing through the label application zone 38, then continues along the conveyor for further handling, such as packing and shipping, and the next article 27 to be labeled goes through the same process, with respect to the next label to be rotated into the label application zone. It is noted that FIG. 4 illustrates one orientation of the vacuum drum assembly relative to the passing articles 27, whereas FIGS. 1 and 2 illustrate the vacuum drum assembly on an opposing side of the conveyor assembly 16. This is merely for the purpose of clarifying that the orientation of the system is a matter of design application—which side of the conveyor assembly the vacuum drum and label applicator assembly are disposed is dependent upon industrial design factors outside of the scope of the present invention.

Figure 5:
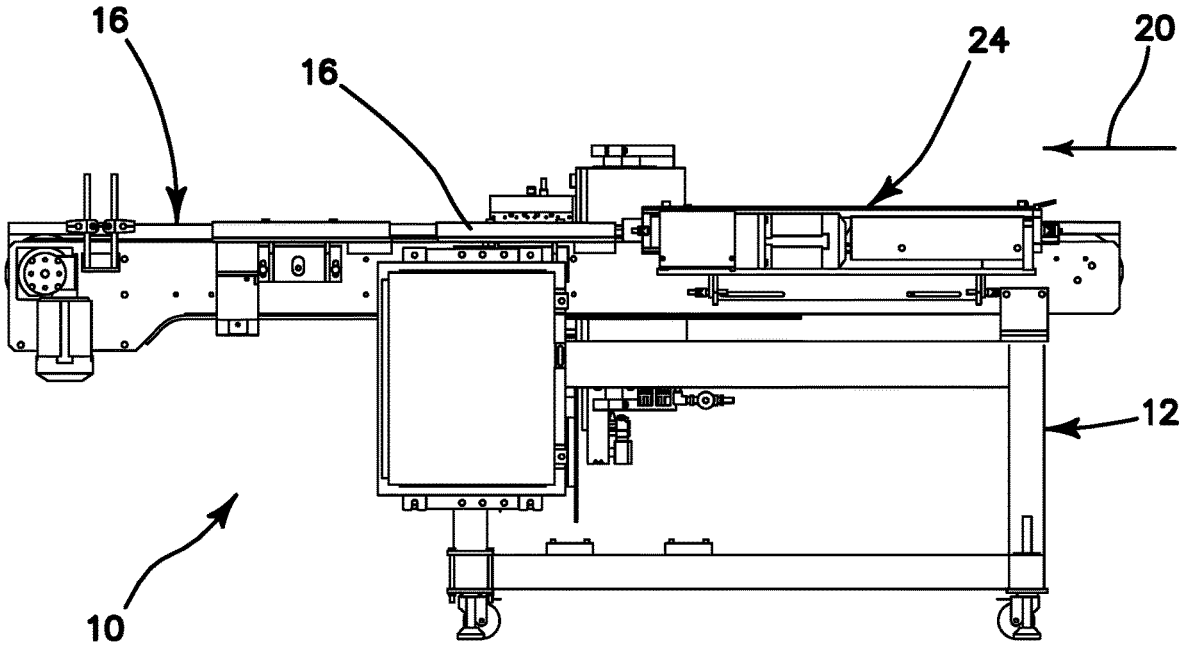
FIG. 5 is an elevational view of a modified embodiment of the labeling system of FIGS. 1 and 2.
Figure 6:
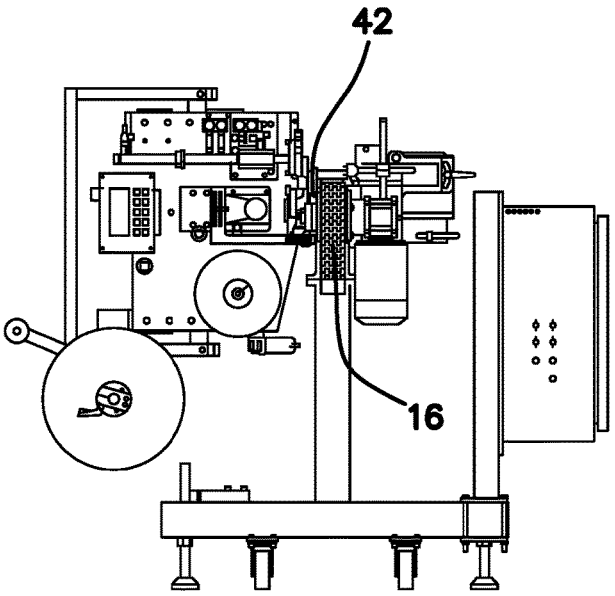
FIG. 6 is an end view of the embodiment of FIG. 5.

FIGS. 5-7 illustrate a modified embodiment of the present invention, which is similar in operational principle to the vacuum drum embodiment of FIGS. 1-2, but instead utilizes a tamp applicator 42 to deliver the label to the spinning article, rather than a vacuum drum. Tamp applicators are well known in the art, for example, as shown and disclosed in commonly assigned U.S. Pat. No. 4,844,771, herein expressly incorporated by reference in its entirety.

In this embodiment, wherein like elements are identified by like reference numerals, as in the vacuum drum embodiment, the article 27 is initiated into a spinning rotation as it travels into the label application zone, then engages a label disposed on the tamp applicator 42, which has been extended so that the upstream end of the label thereon will contact the outer sidewall of the article to be labeled. Again, as the article travels downstream along the conveyor and the moving belt 40, the label will be wrapped about the circumference thereof to complete the labeling process quickly and efficiently, with minimal error rates. The tamp applicator 42 comprises a pad having vacuum apertures therein, a vacuum pad, for receiving a dispensed label thereon, adhesive side up. The pad is extended after receiving a label 31*d* thereon, as it is dispensed from the carrier web 31*c* (FIG. 3), using a hydraulic or pneumatically driven arm, to come into contact with a rotating passing article 27 to be labeled. The arm is then withdrawn to receive the next label, after which the application process is repeated. Significantly, in this alternate embodiment, the articles 27 are rotated using a feedscrew mechanism 24 or vertically-oriented moving belt 40, as in the embodiment of FIGS. 1-4, and then dispensed from the pressure control station, upstream of the label application zone 38, into that zone to receive a label.

What is particularly advantageous about this inventive approach is that the label is stationary in the label application zone, while it is being applied to the spinning article, unlike prior art systems for labeling cylindrical articles using long, thin labels, which utilize a nip method and are fed in the direction of flow of the articles.

While this invention has been described with respect to various specific examples and embodiments, it is to be understood that various modifications may be made without departing from the scope thereof. Therefore, the above description should not be construed as limiting the invention, but merely as an exemplification of preferred embodiments thereof.

What is claimed is:

1. A label application system which applies labels to round or straight-walled articles, comprising:

a main frame;

a label applicator assembly comprising a flat, planar vacuum surface which is sized to receive and retain an entire label to be applied to a cylindrical surface of an article thereon with its adhesive side up;

a conveyor assembly having a conveyor which transports articles to be labeled past the label applicator assembly, the conveyor assembly comprising a label application zone adjacent to the label applicator assembly;

a pressure control assembly upstream of the label application zone which dispenses individual articles to be labeled as they travel down the conveyor toward the label application zone; and a carrier web comprising a plurality of labels which are separable therefrom, to be applied to passing articles, the carrier web being fed to the vacuum surface in a direction of travel transverse to a direction of travel of the conveyor, wherein each label separated from the carrier web has a length and a width, the length of each label being equal to or less than a length of the flat, planar vacuum surface and the width of each label being equal to or less than a width of the flat, planar vacuum surface;

wherein the flat, planar vacuum surface is held in a stationary position while a label is being applied to an article cylindrical surface.

2. The label application system as recited in claim 1, wherein the flat, planar vacuum surface comprises a flat vacuum pad.

3. The label application system as recited in claim 1, wherein the flat, planar vacuum surface comprises a portion of a circumferential surface of a vacuum drum assembly located adjacent to the label application zone for applying labels to passing articles, the vacuum drum assembly being rotatable about an axis lying parallel to a direction of travel of the conveyor.

4. The label application system as recited in claim 3, wherein the vacuum drum assembly comprises a plurality of label flats disposed about its circumferential surface, each of the label flats comprising said flat, planar vacuum surface extending across substantially an entire width of the drum and having a plurality of vacuum apertures therein, for delivering a vacuum pressure to the surface of the label flat to hold a label in place on the label flat surface with its adhesive side up, wherein the circumferential surface of the drum comprises angled transitional edges between each label flat.

5. The label application system as recited in claim 4, and further comprising a motor for rotating the vacuum drum in a stepwise fashion to receive individual labels sequentially as they are separated from a carrier web traveling over a peeler bar adjacent to the vacuum drum.

6. The label application system as recited in claim 1, wherein the pressure control assembly comprises a feedscrew assembly.

7. The label application system as recited in claim 1, wherein the pressure control assembly comprises a vertically oriented moving belt assembly.

8. The label application system as recited in claim 1, and further comprising a belt for rotating the articles as they enter the label application zone.

9. A label application system for applying labels to round or straight-walled articles, comprising:

a main frame;

a label applicator assembly comprising a flat, planar vacuum surface which is sized to receive and retain an entire label to be applied to a cylindrical surface of an article thereon with its adhesive side up;

a conveyor assembly having a conveyor for transporting articles to be labeled past the label applicator assembly, the conveyor assembly comprising a label application zone adjacent to the label applicator assembly; and a pressure control assembly upstream of the label application zone which dispenses individual articles to be labeled as they travel down the conveyor toward the label application zone, the pressure control assembly initiating rotation of each individual round, straight-walled article as the article enters the label application zone;

wherein the flat, planar vacuum surface is held in a stationary position while a label is being applied to the article cylindrical surface.

10. The label application system as recited in claim 9, wherein the flat, planar vacuum surface comprises a flat vacuum pad.

11. The label application system as recited in claim 9, wherein the flat, planar vacuum surface comprises a portion of a circumferential surface of a vacuum drum assembly located adjacent to the label application zone for applying labels to passing articles, the vacuum drum assembly being rotatable about an axis lying parallel to a direction of travel of the conveyor.

12. The label application system as recited in claim 11, wherein the vacuum drum assembly comprises a plurality of label flats disposed about its circumferential surface, each of the label flats comprising said flat, planar vacuum surface extending across substantially an entire width of the drum and having a plurality of vacuum apertures therein, for delivering a vacuum pressure to the surface of the label flat to hold a label in place on the label flat surface with its adhesive side up, wherein the circumferential surface of the drum comprises angled transitional edges between each label flat.

13. The label application system as recited in claim 12, and further comprising a motor for rotating the vacuum drum in a stepwise fashion to receive individual labels sequentially as they are separated from a carrier web traveling over a peeler bar adjacent to the vacuum drum.

14. The label application system as recited in claim 9, and further comprising a carrier web for delivering labels to the label application zone, wherein the labels are fed to the label application zone in a direction transverse to a direction of travel of the conveyor.

15. A method for applying labels to round or straight-walled articles, comprising:

feeding a carrier web on which a plurality of labels are disposed in a direction toward a conveyor which moves round, straight-walled articles through a label application zone, each of the plurality of labels having a length and a width and being sequentially fed onto a flat, planar vacuum surface, so that the entire length and width of the fed label is disposed on the flat, planar vacuum surface, wherein an adhesive side of the fed label faces outwardly toward articles passing by the flat, planar vacuum surface on the conveyor in a downstream direction of travel;

retaining the fed label on the flat, planar vacuum surface using applied vacuum pressure;

holding the flat, planar vacuum surface in a stationary position as an article to be labeled enters the label application zone adjacent to the flat, planar vacuum surface; and applying the fed label to the article to be labeled in the label application zone while holding the flat, planar vacuum surface in the stationary position;

wherein the carrier web feeding direction is transverse to the downstream direction of travel of the conveyor.

16. The method as recited in claim 15, wherein the flat, planar vacuum surface comprises a flat vacuum pad.

17. The method as recited in claim 15, and further comprising using a pressure control assembly upstream of the label application zone for dispensing individual articles to be labeled as they travel along the conveyor toward the label application zone.

18. The method as recited in claim 15, and further comprising a step of separating the label from the carrier web to feed the label onto the flat, planar vacuum surface.

* * * * *